US006838620B2

(12) United States Patent
Murakami et al.

(10) Patent No.: US 6,838,620 B2
(45) Date of Patent: Jan. 4, 2005

(54) STRUCTURE OF MOUNTING TERMINAL TO COVERED ELECTRIC WIRE AND METHOD THEREOF

(75) Inventors: Kazuhiro Murakami, Shizuoka-ken (JP); Yukiko Shimada, Shizuoka-ken (JP); Yuji Nitta, Shizuoka-ken (JP); Kenichi Hanazaki, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/975,055

(22) Filed: Oct. 12, 2001

(65) Prior Publication Data

US 2002/0050385 A1 May 2, 2002

(30) Foreign Application Priority Data

Oct. 13, 2000 (JP) ..... P2000-313572

(51) Int. Cl.[7] ..... H01R 4/20
(52) U.S. Cl. ..... 174/84 C; 439/877
(58) Field of Search ..... 174/74 R, 84 C; 439/877

(56) References Cited

U.S. PATENT DOCUMENTS 3,042,737 A * 7/1962 Brumbach et al. ..... 138/125
3,739,470 A * 6/1973 Eppler ..... 29/872
4,707,566 A * 11/1987 Titcombe et al. ..... 174/78
4,912,443 A * 3/1990 Heyne et al. ..... 335/216
4,959,508 A * 9/1990 McGrane ..... 174/84 C
5,408,743 A * 4/1995 Tournier et al. ..... 29/863
5,499,448 A * 3/1996 Tournier et al. ..... 29/863
6,261,137 B1 * 7/2001 Wilcox ..... 439/877
2002/0034898 A1 * 3/2002 Kuwayama et al. ..... 439/877

FOREIGN PATENT DOCUMENTS

JP 2000-021543 1/2000

* cited by examiner

*Primary Examiner*—Chau N. Nguyen
(74) *Attorney, Agent, or Firm*—Finnegan, Henderson, Farabow, Garrett & Dunner, L.L.P.

(57) ABSTRACT

One end of a terminal is formed in a tube shape, and a front end of a covered electric wire in which a part of a covering is peeled is inserted to the one end of the terminal, and is uniformly caulked from a periphery. A length of the peeled covering is shorter than a depth of the tube-like portion of the terminal. Accordingly, a part of the covering is received in the tube-like portion and caulked so as to serve as an operation of a packing, thereby preventing a water and an air from entering into an inner portion of the tube-like portion. Further, since the tube-like portion is uniformly caulked so as to be closely contact with the electric conductor, it is possible to obtain a comparatively large contact area, and it is possible to obtain a stable conduction.

7 Claims, 6 Drawing Sheets

STRUCTURE OF MOUNTING TERMINAL TO COVERED ELECTRIC WIRE AND METHOD THEREOF

BACKGROUND OF THE INVENTION

1. Field of the Invention

The present invention relates to a structure of mounting a terminal to a covered electric wire and a method thereof.

2. Description of the Related Art

A conventional method of mounting a terminal to a covered electric wire comprises a step of inserting a covered electric wire in which a covering at a front end is peeled and an electric conductor is exposed, to a terminal provided with a pair of hooks and a pair of crimp pieces, a step of crimping a blade with the electric conductor so as to conduct them, and a step of bending the crimp pieces in such a manner as to wrap the covering. As another method of mounting a terminal, there has been known a technique disclosed in Japanese Patent Application Laid-Open No. 2000-21543. In this technique, the terminal is constituted by a receiving portion for receiving a terminal end of an electric wire and a connecting portion for the other connecting terminal, and the method comprises a step of inserting a covered electric wire in which a covering at a front end is peeled, and a step of pressurizing and caulking the receiving portion from six directions with using a pair of dies. In this method, the receiving portion for receiving the electric conductor deforms in a shape having a cross section similar to a hexagon.

SUMMARY OF THE INVENTION

Since the electric conductor of the covered electric wire exposes near a connecting portion to the terminal according to both of the methods, there is a problem that the electric conductor and the terminal are exposed to an air or a water, thereby being easily oxidized. Further, in the technique disclosed in Japanese Patent Application Laid-Open No. 2000-21543 mentioned above, since the deformation is not generated in an axially symmetrical manner, it is easy that a gap is generated between the terminal and the electric conductor, and the air and the water easily enter between the electric conductor and the terminal. If a contact surface between the electric conductor and the terminal is oxidized, there is a problem that a conductivity is significantly reduced.

An object of the present invention is to provide a structure of mounting a terminal to a covered electric wire which is excellent in a sealing performance of an electric conductor and a contact surface of the terminal with the electric conductor, and can obtain a stable conductivity, and a method thereof.

According to the present invention, one end of a terminal is formed in a tube shape, and a terminal end of a covered electric wire in which a part of a covering is peeled is inserted to the one end of the terminal, and is uniformly caulked from a periphery. A length of the peeled covering is shorter than a depth of the tube-like portion of the terminal. Accordingly, a part of the covering is received in the tube-like portion and caulked so as to serve as an operation of a packing, thereby preventing water and an air from entering into an inner portion of the tube-like portion. Further, since the tube-like portion is uniformly caulked so as to be closely contact with the electric conductor, it is possible to obtain a comparatively large contact area, and it is possible to obtain a stable conduction.

According to a second aspect of the present invention, there is provided a mounting structure as recited above, wherein the tube-like portion is formed in a cylindrical shape, and the tube-like portion of the terminal to which the terminal end of the covered electric wire is inserted is drawn in an axial direction while being caulked. Since the tube-like portion has the cylindrical shape, it is possible to uniformly pressurize all around an outer periphery, and it is possible to plastically deform the terminal and the electric conductor In an axially symmetrical manner. Accordingly, it is possible to obtain a higher sealing performance and a more stable conduction than the case mentioned above.

According to a third aspect of the present invention, there is provided a mounting structure as recited above, wherein a plurality of projections for engaging with the covering of the covered electric wire and the electric conductor are provided on an inner surface of the tube-like portion in the terminal. In the structure mentioned above, the area in which the inner surface of the tube-like portion of the terminal and the electric conductor are in contact with each other is further increased, so that a smaller contact resistance and a stable conduction can be obtained.

In the structure of mounting the terminal according to the present invention, it is possible to more uniformly compress by using a swaging machine for compressing the tube-like portion. According to this method, it is possible to produce the terminal mounting structure provided with a further higher waterproof property.

DETAILED DESCRIPTION OF THE PREFERRED EMBODIMENT

A description will be given of a first embodiment according to the present invention with reference to FIGS. 1 to 8.

Figure 1:
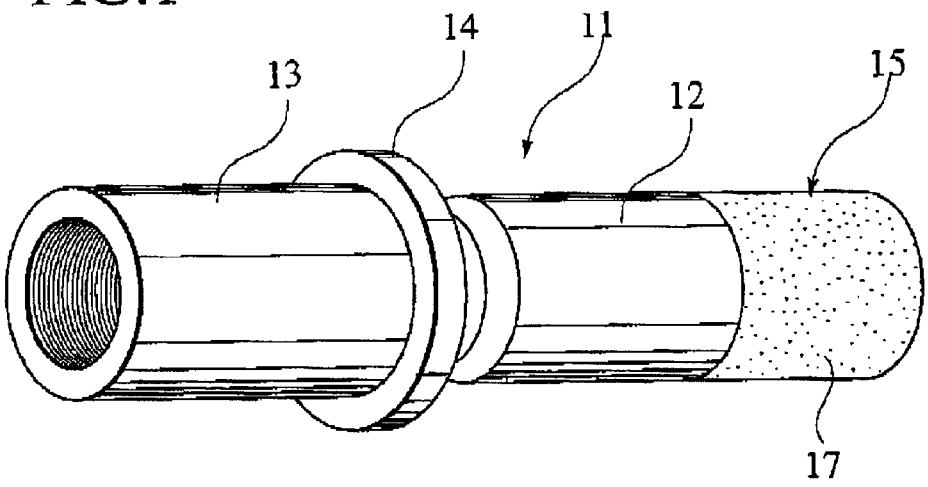
FIG. 1 is a perspective view showing a structure of mounting a terminal to a covered electric wire according to a first embodiment of the present invention.
Figure 2:
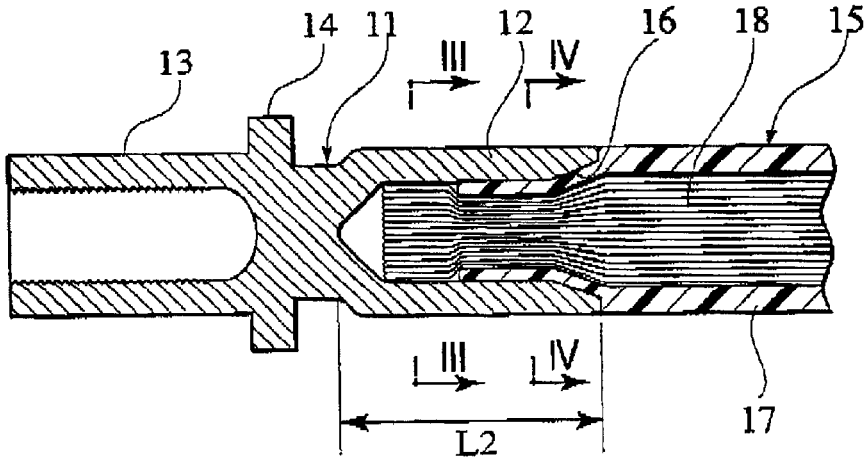
FIG. 2 is a cross sectional-view in an axial direction of the structure of mounting the terminal to the covered electric wire according to the first embodiment of the present invention.

In a terminal mounting structure according to the first embodiment, a connecting terminal 11 shown in FIGS. 1 and 2 is employed. The connecting terminal 11 is integrally constituted by a cylindrical wire end receiving portion 12 one end of which is opened so as to receive a covered electric wire, and a cylindrical connecting portion 13 for connecting to the other equipment. The connecting terminal 11 is provided with an outward protruding flange 14 near a center as seen from both ends. The connecting terminal 11 mentioned above is manufactured from a metal suitable for a plastic working.

A portion near the opening portion on the inner side surface of the wire end receiving portion 12 is formed as a guiding taper surface 16 as shown in FIG. 2. The guiding taper surface 16 makes an operation of inserting a covered electric wire 15 into the wire end receiving portion 12 easy.

Figure 5:
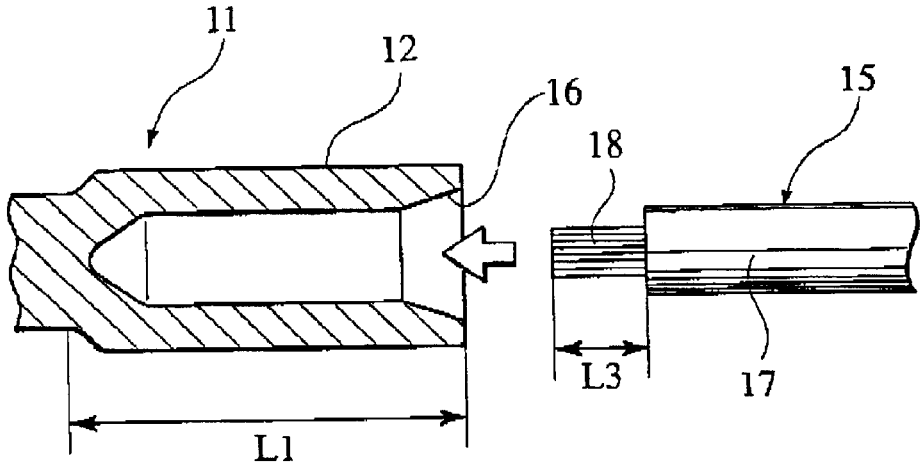
FIG. 5 is a schematic view showing a main portion of a method of mounting a terminal to a covered electric wire according to the first embodiment of the present invention.
Figure 6:
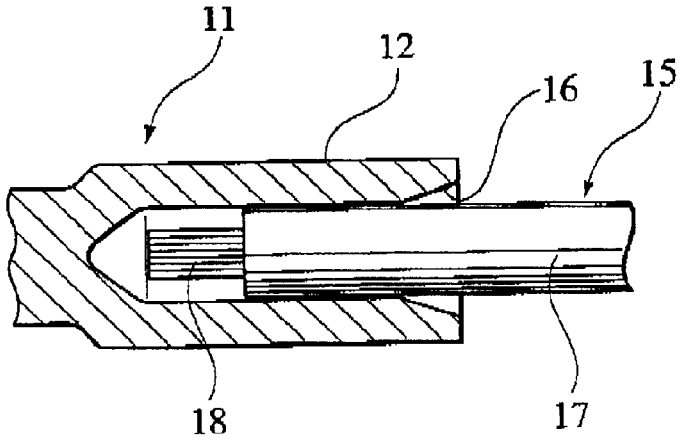
FIG. 6 is a schematic view showing a state of inserting the covered electric wire to a tube-like portion of the terminal in the method of mounting the terminal to the covered electric wire according to the first embodiment of the present invention.

In a terminal end of the covered electric wire 15, as shown in FIG. 5, a covering 17 made of an insulating resin is peeled at a predetermined size L3 shorter than a depth L1 of the wire end receiving portion 12, and an electric conductor 18 is exposed. Then, the covered electric wire 15 is inserted in a direction shown by a thick arrow in FIG. 5, and the terminal end of the covered electric wire 15 is received within the wire end receiving portion 12 as shown in FIG. 6. At this time, the terminal end of the covered electric wire 15 can be smoothly inserted within the wire end receiving portion 12 on the sake of the guiding taper surface 16.

Figure 7:
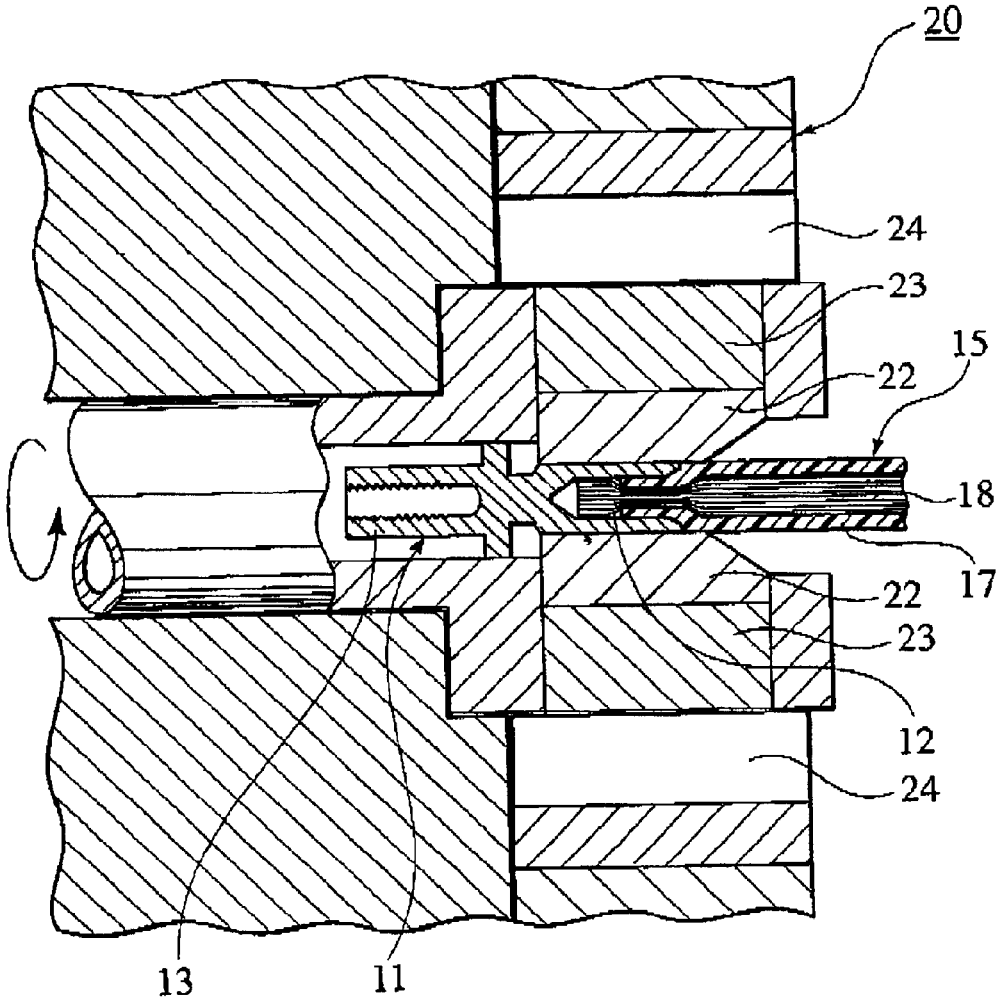
FIG. 7 is a cross sectional view showing a step of caulking by using a swaging machine in the method of mounting the terminal to the covered electric wire according to the first embodiment of the present invention.
Figure 8:
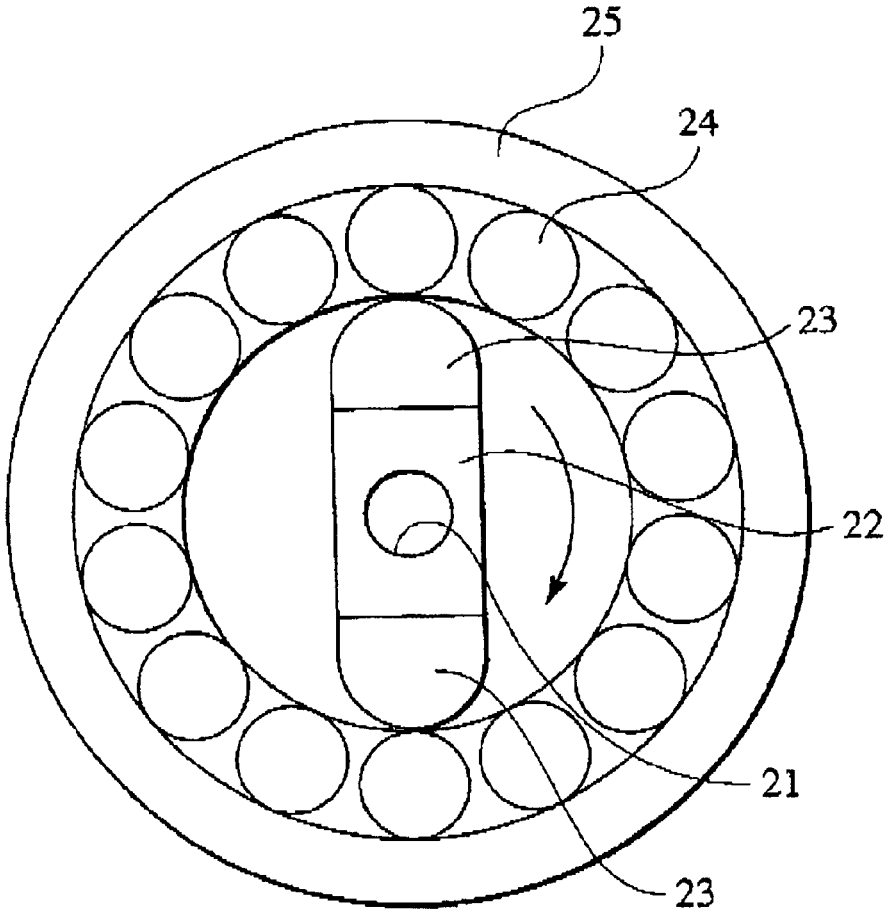
FIG. 8 is a front view of the swaging machine used in the first embodiment according to the present invention.

Next, the wire end receiving portion 12 and the covered electric wire 15 are caulked by a swaging machine as shown in FIG. 7. A swaging machine 20 is provided with dies 22 having a through hole 21, a pair of hammers 23 arranged in both ends of the dies 22, a plurality of rollers 24 for making the hammers 23 execute a motion in a radial direction in correspondence to a rotation of the dies 22 and the hammers 23, and an outer race receiving the rollers 24, as shown in FIG. 8. The swaging machine gives an oscillating motion in the radial direction to plural sets of dies opposing to each other so as to compress from an outer periphery of the wire end receiving portion 12 of the connecting terminal 11 and squeeze out in the axial direction, thereby uniformly caulking a whole periphery of the wire end receiving portion 12.

Figure 3:
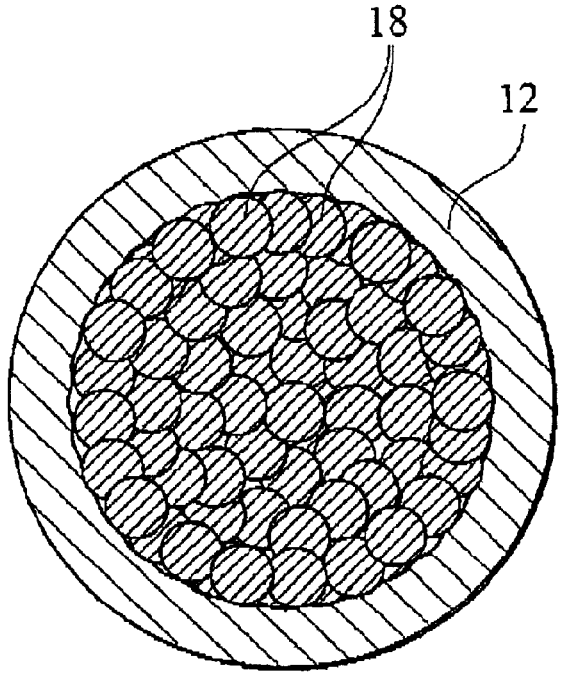
FIG. 3 is a cross sectional view of the structure of mounting the terminal to the covered electric wire according to the first embodiment of the present invention along a line III—III in FIG. 2.
Figure 4:
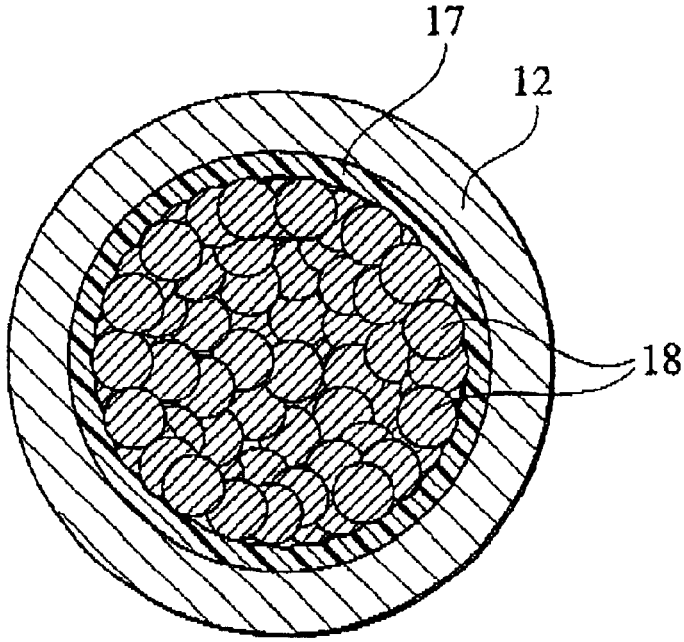
FIG. 4 is a cross sectional view of the structure of mounting the terminal to the covered electric wire according to the first embodiment of the present invention along a line IV—IV in FIG. 2.

A diameter of the wire end receiving portion 12 is uniformly compressed and is simultaneously extended in the axial direction, thereby being crimped with the covered electric wire 15. As a result, a length of the wire end receiving portion 12 becomes L2, which is longer than an initial length L1. The electric conductor 18 is compressed in the radial direction, and becomes in a state of being bit into each other while being plastically deformed. Further, as shown in FIG. 3, the conductor 18 and the wire end receiving portion 12 become in a state of being bit into each other and a contact area between the electric conductor 18 and the wire end receiving portion 12 is increased. The covering 17 received within the wire end receiving portion 12 is compressed in the radial direction, whereby a closely contact performance with the inner surface of the wire end receiving portion 12 is increased as shown in FIG. 4. Further, since an open end of the wire end receiving portion 12 is extended in the axial direction, the open end bites into the covering 17 in the axial direction.

Another connecting terminal (not shown) is connected to the connecting portion 13. In the drawings, the connecting portion 13 is structured such as to be engaged with another connecting terminal, however, may be constituted by a male type or a female type connecting portion which is simply fitted and connected.

A description will be given of a relation between the wire end receiving portion 12 and the covered electric wire 15 and a relation between the electric conductors 18 with reference to FIGS. 2 to 4.

In the terminal end of the covered electric wire 15, as shown in FIGS. 2 and 3, the electric conductor 18 in the portion where the covering 17 is peeled is crimped so as to bite into the inner surface of the wire end receiving portion 12. Accordingly, the contact area between the wire end receiving portion 12 and the electric conductor 18 which carries out an electric connection between the covered electric wire 15 and the connecting terminal 11 is increased, whereby a contact resistance is restricted to be low, and a gap between the both is reduced. Therefore, it is possible to prevent an air and water from entering between the both and it is possible to restrict an oxidization of the contact surface. Together therewith, since a contact between the inner surface of the wire end receiving portion 12 and the electric conductor 18 is stable, it is possible to restrict a fluctuation of an electric resistance.

The electric conductor 18 is constituted by a bundle of conductive wires, however, since the conductive wires are crimped so as to be bit into each other as shown in FIGS. 3 and 4, the contact area between the respective conductive wires is increased, whereby it is possible to restrict the contact resistance to be low and the gap between the conductive wires is reduced. Accordingly, it is possible to prevent the air and the water from entering between the conductive wires, and it is possible to restrict the oxidization of the electric conductor 18.

Further, as shown in FIGS. 2 and 4, a part of the covering 17 made of the insulative resin is received and caulked in the inner surface of the wire end receiving portion 12. This serves an operation as a packing, whereby it is possible to prevent the water and the air from entering into the inner portion of the wire end receiving portion 12.

In the terminal mounting structure according to the present embodiment having the structure mentioned above, since it is possible to prevent the covered electric wire 15 provided with a waterproof function and the inner surface of the wire end receiving portion 12 from being oxidized and deteriorated, it is possible to realize the terminal mounting structure in which the electric resistance is low and stable.

Next, a description will be given of a second embodiment according to the present invention with reference to FIG. 9. The same reference numerals are attached to the same elements as those of the first embodiment, and a detailed description thereof will be omitted.

Figure 9:
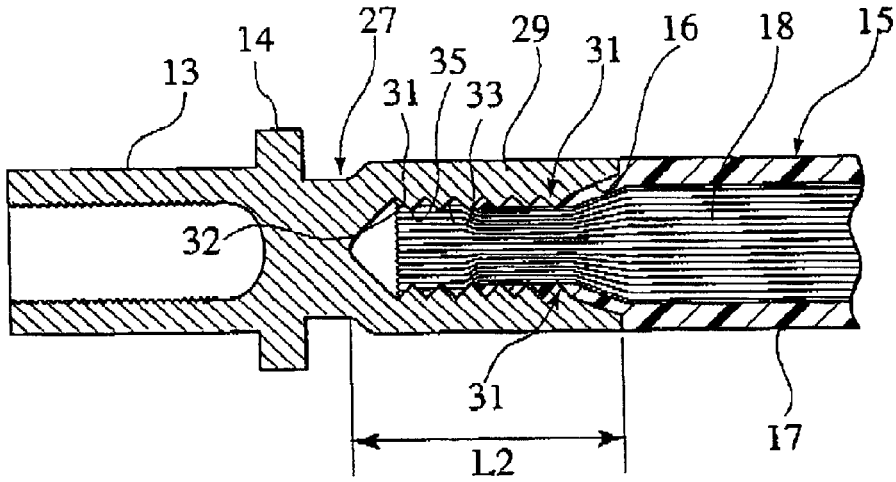
FIG. 9 is a cross sectional view of a structure of mounting a terminal to a covered electric wire according to a second embodiment of the present invention.

In the terminal mounting structure according to the second embodiment of the present invention, a connecting terminal 27 shown in FIG. 9 is employed. The connecting terminal 27 is integrally constituted by a cylindrical wire end receiving portion 13 one end of which is opened so as to receive a covered electric wire, and a cylindrical connecting portion 29 for connecting to the other equipment. The connecting terminal 27 is provided with an outward protruding flange 14 near a center as seen from both ends. The connecting terminal 27 mentioned above is manufactured from a metal suitable for a plastic working.

A plurality of projections 31 are provided on an inner surface of the wire end receiving portion 29. A plurality of projections 31 are formed in an annular shape, are respectively formed along a circumferential direction of the inner surface of the wire end receiving portion 29 and are arranged in a longitudinal direction of the wire end receiving portion 29 at a uniform interval. These projections 31 are structured such that a thickness thereof is gradually reduced from a base portion toward a front end and the front end forms an edge 35. The edge 35 makes an engagement of the covering 17 and the electric conductor 18 executed by a plurality of projections 31 mentioned below easy.

The shape of the projection 31 can employ various structures in addition to the shape mentioned above. A plurality of projections 31 are respectively formed in an annular shape in the structure mentioned above, however, the structure may be made such that a plurality of projections are annularly arranged along a circumferential direction. A cross sectional shape of the projection 31 may employ a rectangular shape. Further, in the above structure, a plurality of projections 31 are arranged at a uniform interval, however, one or a plurality of spiral projections may be employed.

An inner side surface near the opening portion of the wire end receiving portion 29 forms a guiding taper surface 16 as shown in FIG. 9. The guiding taper surface 16 makes an operation of inserting the covered electric wire 15 within the wire end receiving portion 29 easy.

Figure 10:
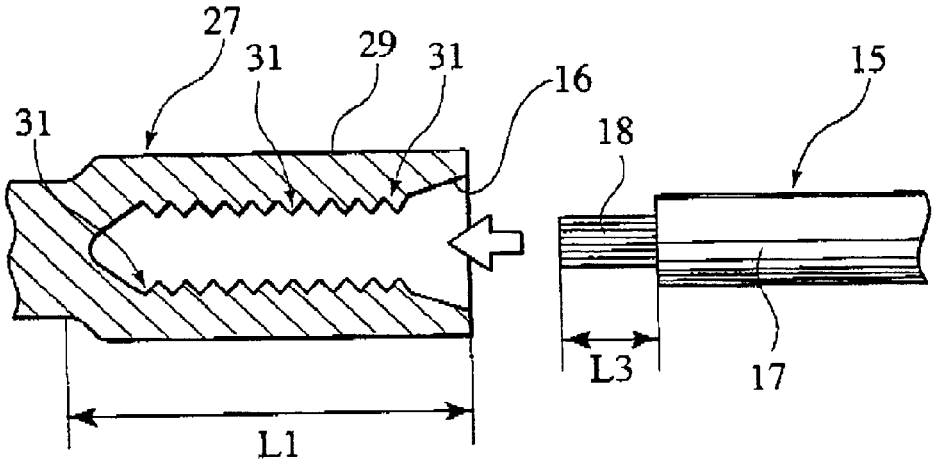
FIG. 10 is a schematic view showing a main portion of a method of mounting a terminal to a covered electric wire according to the second embodiment of the present invention.

In a terminal end of the covered electric wire 15, as shown in FIG. 5, a covering 17 made of an insulating resin is peeled at a predetermined size L3 shorter than a depth L1 of the wire end receiving portion 29, and an electric conductor 18 is exposed. Then, the covered electric wire 15 is inserted in a direction shown by a thick arrow in FIG. 10, and the terminal end of the covered electric wire 15 is received within the wire end receiving portion 29. At this time, the terminal end of the covered electric wire 15 can be smoothly inserted within the wire end receiving portion 29 on the sake of the guiding taper surface 16.

Next, the wire end receiving portion 29 and the covered electric wire 15 are caulked by a swaging machine so that a whole circumference becomes uniform. A diameter of the wire end receiving portion 29 is uniformly compressed and is simultaneously extended in the axial direction, thereby being crimped with the covered electric wire 15. As a result, a length of the wire end receiving portion 29 becomes L2, which is longer than an initial length L1. The electric conductor 18 is compressed in the radial direction, and becomes in a state of being bit into each other while being plastically deformed. The projections 31 become in a state of being bit into the electric conductor 18, and a contact area between the electric conductor 18 and the wire end receiving portion 29 is increased. The projections 31 become in a state of being bit into the covering 17 received within the wire end receiving portion 29, whereby a closely contact performance is increased. Further, since an open end of the wire end receiving portion 29 is extended in the axial direction, the open end bites into the covering 17 in the axial direction.

In the structure of mounting the terminal to the covered electric wire 15 in which the connecting terminal 27 is used, the electric conductor 18 ate the terminal end of the covered electric wire 15 in which the predetermined length is peeled from the front end of the covering 17, and the covering 17 are engaged with a plurality of projections 31 so as to be crimped with the inner surface of the wire end receiving portion 29. Accordingly, in comparison with the case of the first embodiment, the contact area between the covered electric wire 15 and the connecting terminal 11 becomes further greater around the length of the wire end receiving portion 29, and the contact resistance becomes further smaller. Further, it is possible to effectively prevent the covered electric wire 15 from coming off and it is possible to secure a stable conduction. Further, since a gap between the covered electric wire 15 and the wire end receiving portion 29 becomes even smaller, it is possible to prevent the air and the water from entering between the both, and it is possible to restrict the oxidization of the contact surface.

The electric conductor 18 is constituted by a bundle of conductive wires, however, since the conductive wires are crimped so as to be bit into each other, the contact area between the respective conductive wires is increased, whereby it is possible to restrict the contact resistance to be low and the gap between the conductive wires is reduced. Accordingly, it is possible to prevent the air and the water from entering between the conductive wires, and it is possible to restrict the oxidization of the electric conductor 18.

Further, as shown in FIG. 9, the projections 31 of the wire end receiving portion 29 bite into a part of the covering 17 made of the insulative resin. This serves an operation as a packing, whereby it is possible to prevent the water and the air from entering into the inner portion of the wire end receiving portion 29.

In the terminal mounting structure according to the present embodiment having the structure mentioned above, since it is possible to prevent the covered electric wire 15 provided with a waterproof function and the inner surface of the wire end receiving portion 12 from being oxidized and deteriorated, it is possible to realize the terminal mounting structure in which the electric resistance is low and stable.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A structure for mounting a terminal to a covered electric wire comprising:

a terminal comprising a cylindrical wire end receiving portion and a cylindrical connecting portion for connecting to other equipment, wherein an inner surface of the wire end receiving portion comprises a plurality of annular projections; and a covered electric wire from which a leading end of a covering is removed to expose a leading end of an electric conductor, the wire end receiving portion receiving the leading end of the exposed electric conductor of the covered electric wire and a part of the covering, and the wire end receiving portion being uniformly compressed around substantially the entire periphery thereof to be in close contact with the exposed electric conductor.

2. The structure for mounting a terminal to a covered electric wire of claim 1, wherein an outer shape of the wire end receiving portion has a cylindrical shape, and the wire end receiving portion is compressed around an outer portion.

3. The structure for mounting a terminal to a covered electric wire of claim 1, wherein the wire end receiving portion is further extended in an axial direction due to plastic deformation.

4. The structure for mounting a terminal to a covered electric wire of claim 1, further comprising an outward protruding flange on the terminal.

5. The structure for mounting a terminal to a covered electric wire of claim 1, wherein the cylindrical connecting portion comprises a hollow interior for connecting to other equipment.

6. A method of mounting a terminal to a covered electric wire comprising:

removing a front end of a covering on the covered electric wire to expose a leading end of an electric conductor;

receiving the leading end of the electric conductor and a part of the covering in a cylindrical wire end receiving portion of the terminal; and uniformly compressing the cylindrical wire end receiving portion around the entire circumference in a radial direction so that the cylindrical wire end receiving portion and at least a portion of the leading end of the electric conductor plastically deform, and so that a plurality of annular projections on an inner surface of the wire end receiving portion contact the part of the covering of the covered electric wire.

7. The method of mounting a terminal to a covered electric wire of claim 6, wherein the uniformly compressing comprises using a swaging machine.

* * * * *